US006962100B2

(12) United States Patent
Hsien

(10) Patent No.: US 6,962,100 B2
(45) Date of Patent: Nov. 8, 2005

(54) POLYGONAL MEMBER ENGAGING DEVICE

(76) Inventor: Chih-Ching Hsien, No. 367, Pei-Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/916,389

(22) Filed: Aug. 12, 2004

(65) Prior Publication Data

US 2005/0092139 A1 May 5, 2005

Related U.S. Application Data

(63) Continuation-in-part of application No. 10/695,987, filed on Oct. 30, 2003, now abandoned.

(51) Int. Cl.[7] ..... B25B 13/06
(52) U.S. Cl. ..... 81/186; 81/121.1; 81/124.3
(58) Field of Search ..... 81/119, 121.1, 81/124.3, 124.7, 177.85, 186

(56) References Cited

U.S. PATENT DOCUMENTS

| | | | | |
|---|---|---|---|---|
| 5,295,422 | A * | 3/1994 | Chow | 81/124.3 |
| 5,819,606 | A * | 10/1998 | Arnold | 81/124.3 |
| 6,314,840 | B2 * | 11/2001 | Bozonnet | 81/121.1 |
| 6,679,141 | B1 * | 1/2004 | Bozonnet | 81/121.1 |
| 6,745,649 | B1 * | 6/2004 | Liao | 81/121.1 |

* cited by examiner

*Primary Examiner*—Debra S. Meislin

(57) ABSTRACT

A polygonal member engaging device includes a box end and a handle connected to the box end. The box end has a hole for receiving an engaging ring therein which has a plurality of ridges and grooves defined in an inner periphery thereof a clamping hole of the engaging ring. The ridges and the grooves are alternatively arranged from each other in the inner periphery of the clamping hole and each ridge has an enlarged portion extending radially outward therefrom and a width "W1" between two adjacent enlarged portions of the ridges is smaller than a width "L1" of a bottom of each groove.

10 Claims, 8 Drawing Sheets

POLYGONAL MEMBER ENGAGING DEVICE

FIELD OF THE INVENTION

This is a Continuation-In-Part application of applicant's former application with application Ser. No. 10/695,987, filed on Oct. 30, 2003 now abandoned.

BACKGROUND OF THE INVENTION

A conventional box end 100 is shown in FIG. 10 and generally includes twelve ridges 101 and grooves 102 defined in an inner periphery of the box end 100. The ridges 101 and the grooves 102 are arranged in alternative arrangement with each other so that a hexagonal shaped nut 103 can be received in the box end 100 and each peak portion 1030 of the nut 103 is received in one of the grooves 102 and each side 1031 is in contact with the ridges 101. Nevertheless, it is noted that the width "W1" of the width of each ridge 101 is smaller than the width "W" of the opening between the adjacent ridges 101. The width "W1" is smaller than a width of the base of each ridge 101, and the width "W" of the opening is smaller than a width of the bottom of the groove 102. There will be gaps defined between the two adjacent ridges 101 and each peak portion 1030 because the width "W" such that one of two adjacent sides 1031 is not in contact with the ridge 101. In other words, the peak portions 1030 are not well clamped by the ridges 101 and the box end 100 has to be rotated an angle to let the ridges 101 touch the sides 1031 of the nut 103 to rotate the nut 103. This could break the peak portions 1030 because the peak portions 1030 are not clamped firmly.

The present invention intends to provide a polygonal member engaging device whose ridges and grooves are shaped and sized so that the nut can be snugly matched and clamped.

SUMMARY OF THE INVENTION

The present invention relates to a polygonal member engaging device which comprises a box end and a handle connected to the box end. The box end has a hole defined therethrough and an engaging ring is rotatably retained in the hole. The engaging ring has a plurality of ridges and grooves defined alternatively in an inner periphery of a clamping hole of the engaging ring. Each ridge has an enlarged portion extending radially outward therefrom and a width "W1" between two adjacent enlarged portions of the ridges is smaller than a width "L1" of a bottom of each groove.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
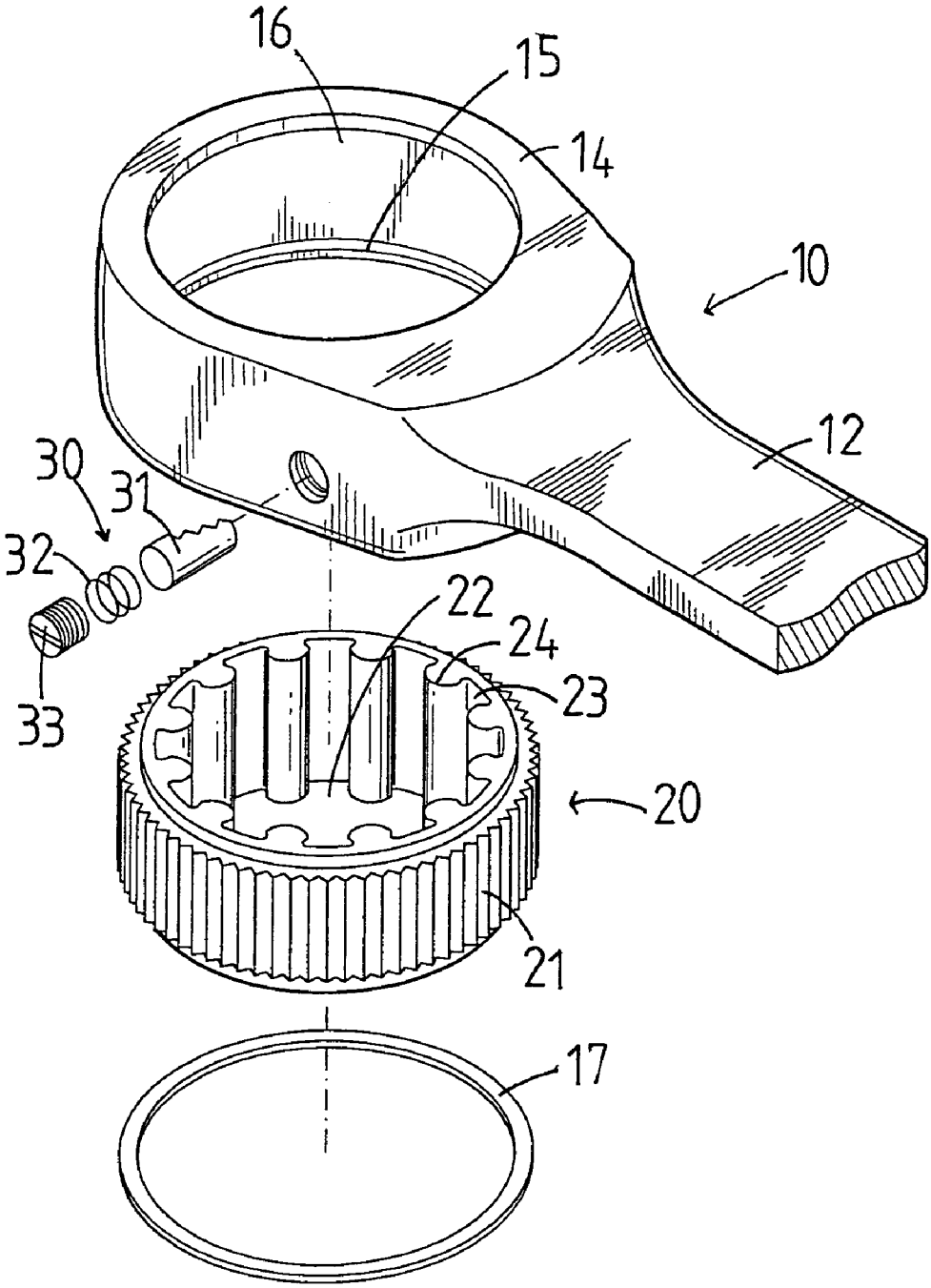
FIG. 1 is an exploded view to show a ratchet polygonal member engaging device of the present invention.
Figure 2:
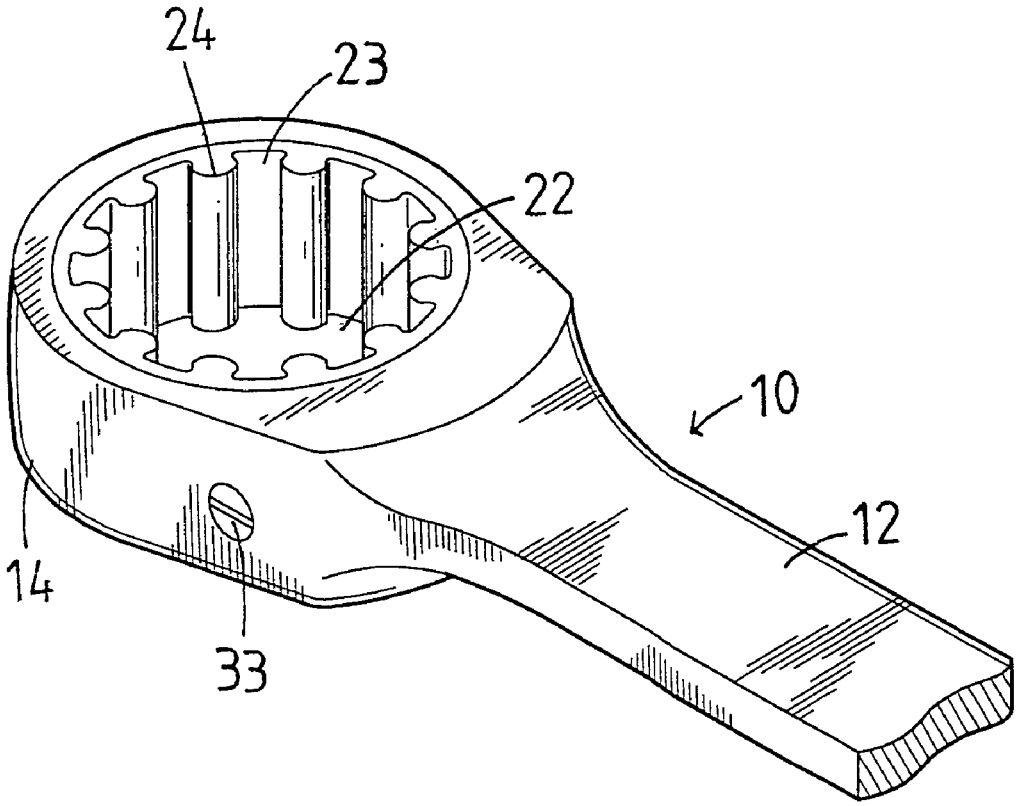
FIG. 2 is a perspective view to show the ratchet polygonal member engaging device of the present invention.
Figure 3:
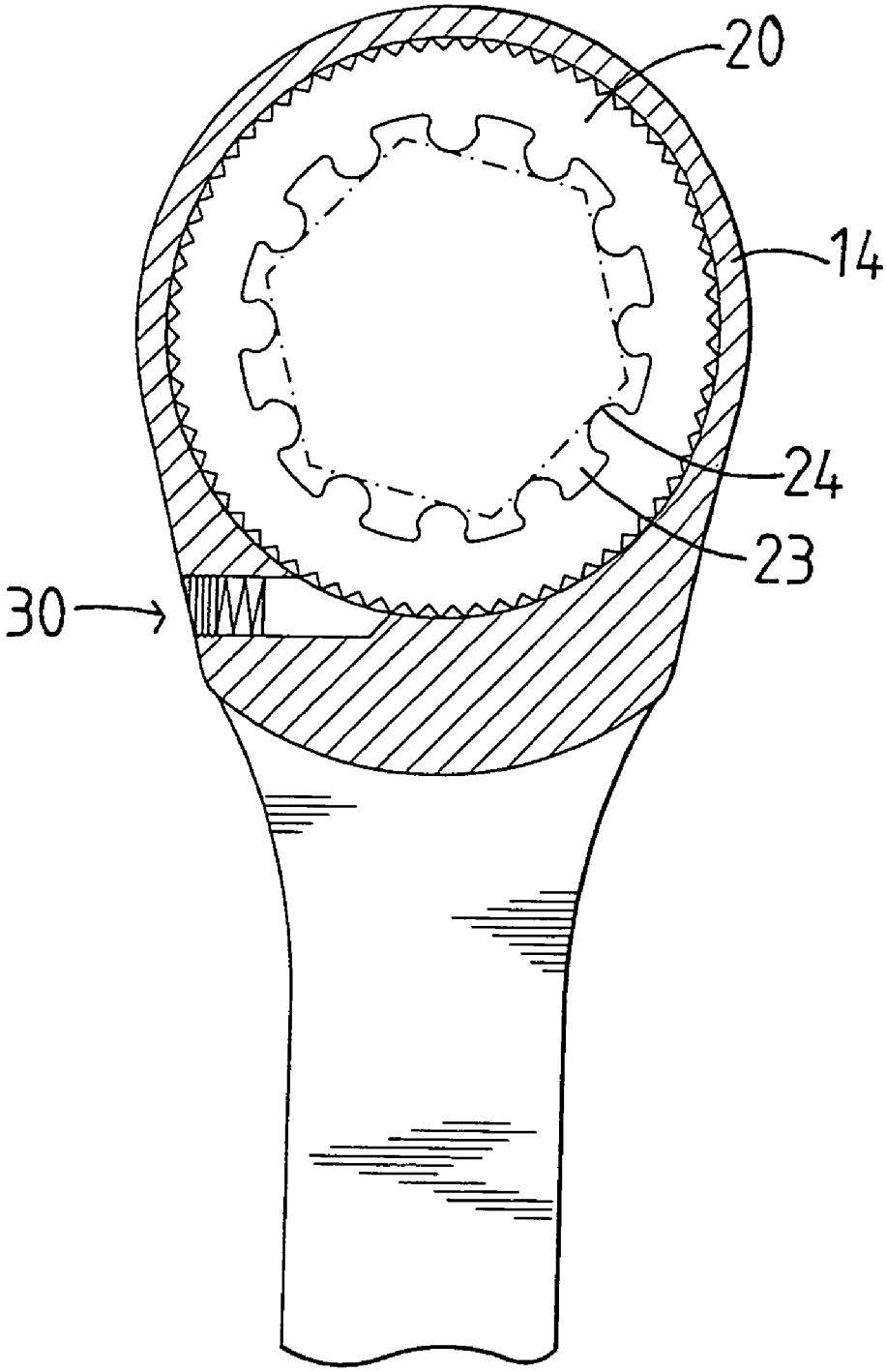
FIG. 3 is a cross sectional view to show the ratchet ratchet polygonal member engaging device of the present invention.
Figure 4:
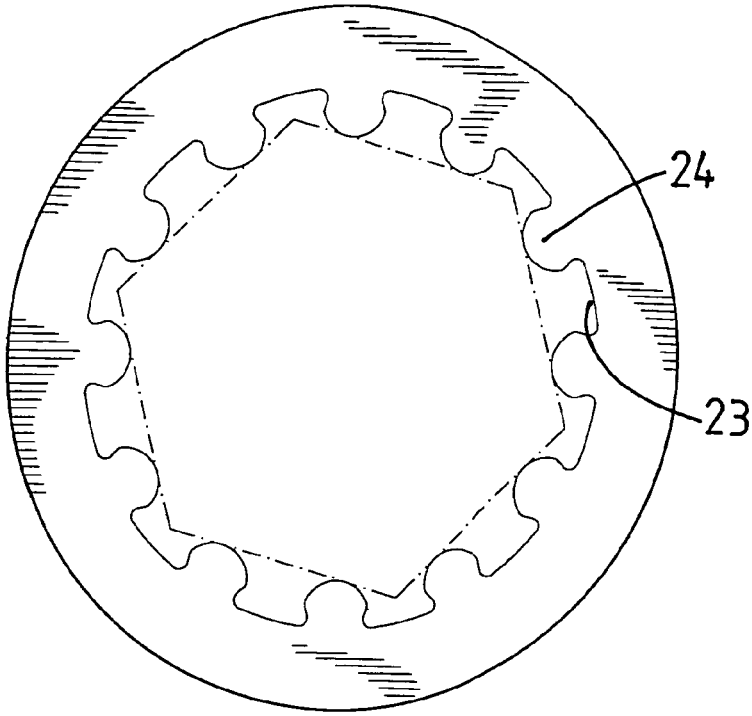
FIG. 4 shows a nut is matched by the engaging ring.
Figure 5:
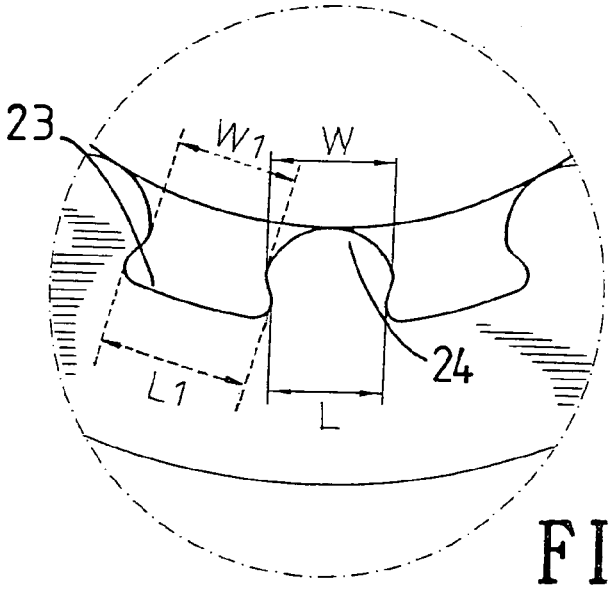
FIG. 5 discloses the dimension relationship of the ridges and the grooves of the ratchet polygonal member engaging device of the present invention.

Referring to FIGS. 1 to 5, the polygonal member engaging device 10 of the present invention can be a ratchet wrench in this embodiment and comprises a box end 14 and a handle 12 connected to the box end 14. The box end 14 has a hole 15 defined therethrough and an engaging ring 20 is rotatably retained in the hole 15 by a retaining ring 17 engaged with a groove 15 defined in an inner periphery of the hole 15. A passage is defined through the box end 14 and communicates with the hole 15 so that a ratchet mechanism 30 is relieved in the passage. The ratchet mechanism 30 includes a pawl 31 biased by a spring 32 and an end piece 33 is threadedly engaged with the passage and seals the passage.

The engaging ring 20 has a toothed outer periphery 21 which is engaged with the pawl 31. A plurality of ridges 24 and grooves 23 are defined in an inner periphery of a clamping hole 22 of the engaging ring 20, and the ridges 24 and the grooves 23 are alternatively arranged from each other in the inner periphery of the clamping hole 22 of the engaging ring 20. Each ridge 24 has an enlarged portion extending radially outward therefrom and a width "W" of the enlarged portion is less than a width "L" of a root portion of each ridge 24. A width "W1" between two adjacent enlarged portions of the ridges 24 is smaller than a width "L1" of a bottom of each groove 23. In other words, the width "W1" between two adjacent enlarged portions is the narrowest width of each groove 23. Preferably, a ratio of the width "W1" between two adjacent enlarged portions and the width "L1" of the bottom of the groove 23 is 1:1.2.

By this specific arrangement, a polygonal nut can be well clamped by the ridges 24 and each side of the nut is in contact with two ridges 24 and the peak portions of the nut are not likely to slip over the ridges 24 during operation.

Figure 6:
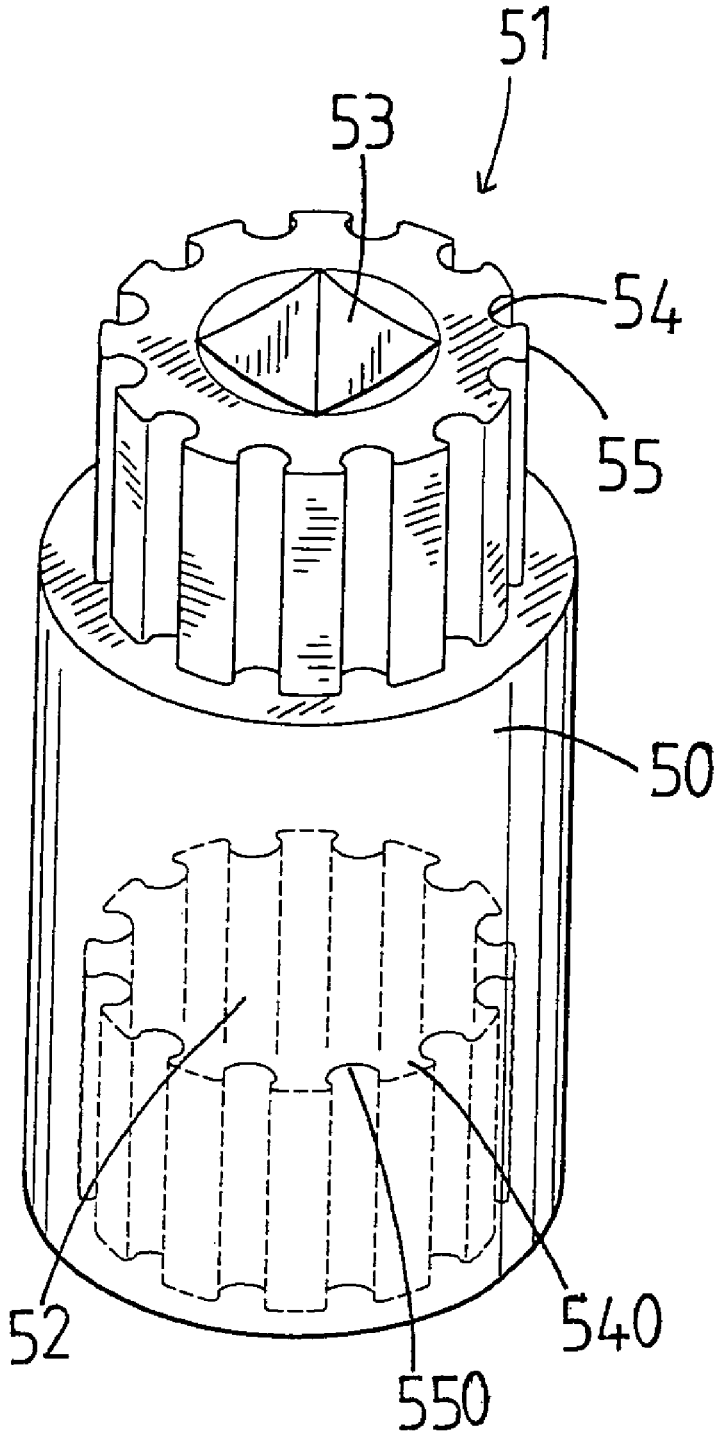
FIG. 6 shows an embodiment as a socket of the present invention.
Figure 7:
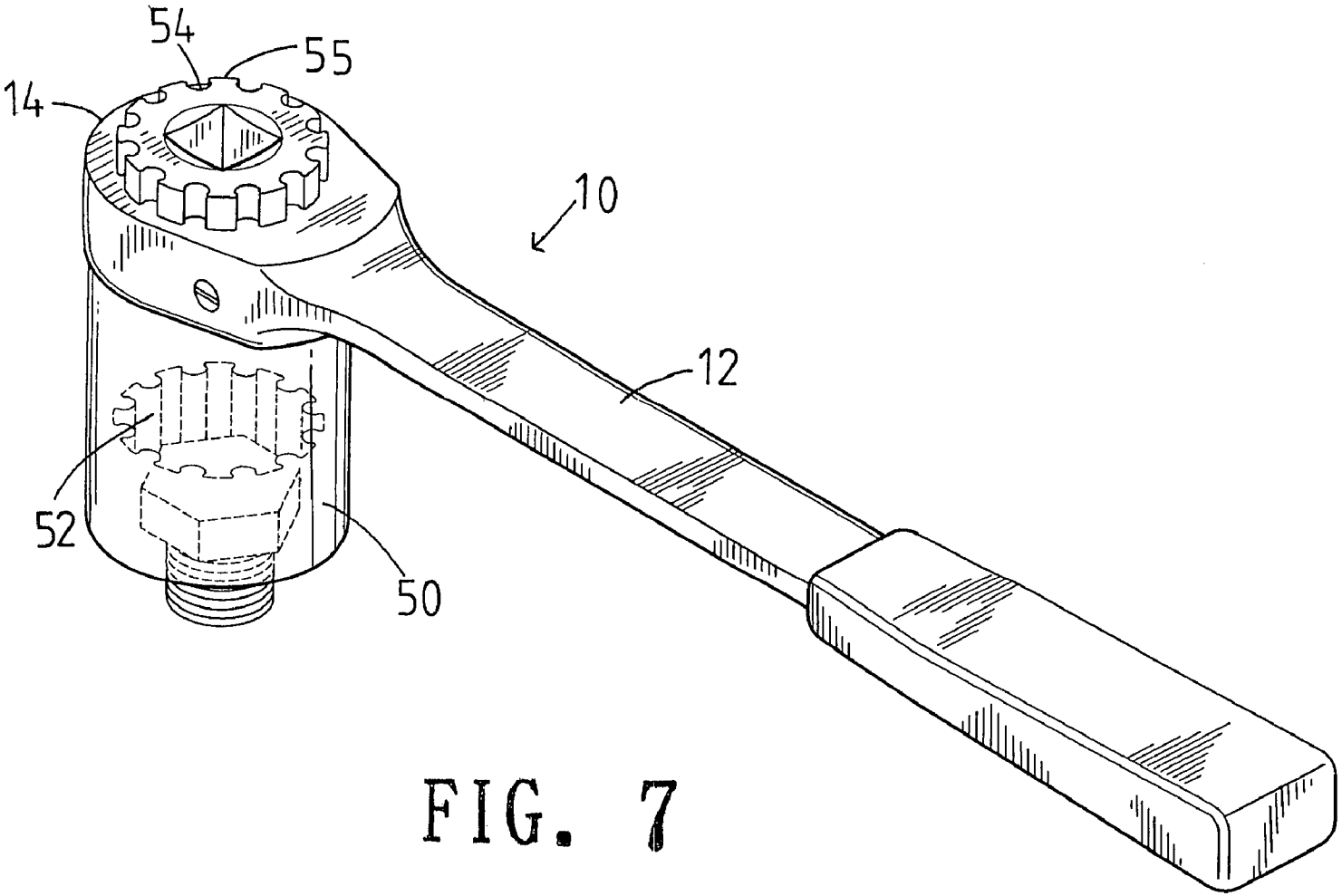
FIG. 7 shows the socket as shown in FIG. 6 is driven by the ratchet polygonal member engaging device of the present invention.

As shown in FIGS. 6 and 7, the polygonal member engaging device of the present invention can be a socket that includes a tubular body 50 and an engaging recess 52 is defined in a first end of the tubular body 50. An engaging part 51 extends from a second end of the tubular body 50 and includes alternatively arranged ridges 55 and grooves 54. The size and shape of the ridges 55 and grooves 54 are matched with the grooves 23 and the ridges 24 of the engaging ring 20 in the ratchet wrench, such that the engaging part 51 can be engaged with the clamping hole 22 of the engaging ring 20 of the wrench. A plurality of ridges 550 and grooves 540 are defined in an inner periphery of the engaging recess 52. The ridges 550 and the grooves 540 are alternatively arranged from each other. All the features, the sizes and the shapes of the ridges 550 and grooves 540 are the same as the ridges 24 and grooves 23 in the engaging ring 20 of the embodiment disclosed in FIG. 1. In other words, the width "W1" between two adjacent enlarged portions of the ridges 550 is smaller than the width "L1" of a bottom of each groove 540. The ratio of the width "W1" between two adjacent enlarged portions of the ridges 550 and the width "L1" of the bottom of the groove 540 is 1:1.2. The width "W1" between two adjacent enlarged portions is the narrowest width of each groove 540. Furthermore, the engaging part 51 has a rectangular hole 53 defined therein which can be connected with a driving stub of tool.

Figure 9:
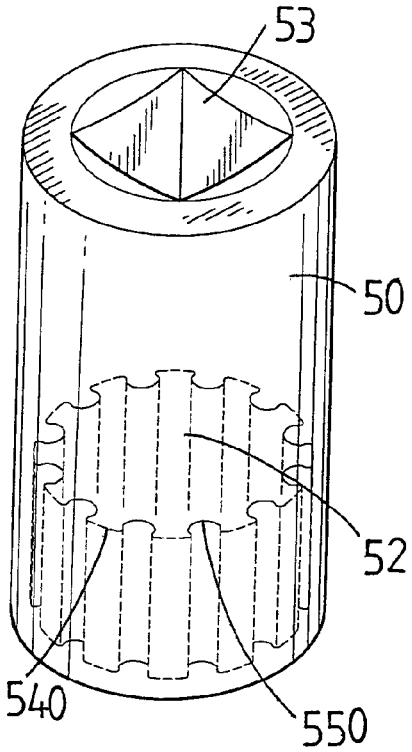
FIG. 9 shows yet another embodiment as a socket of the present invention.
Figure 8:
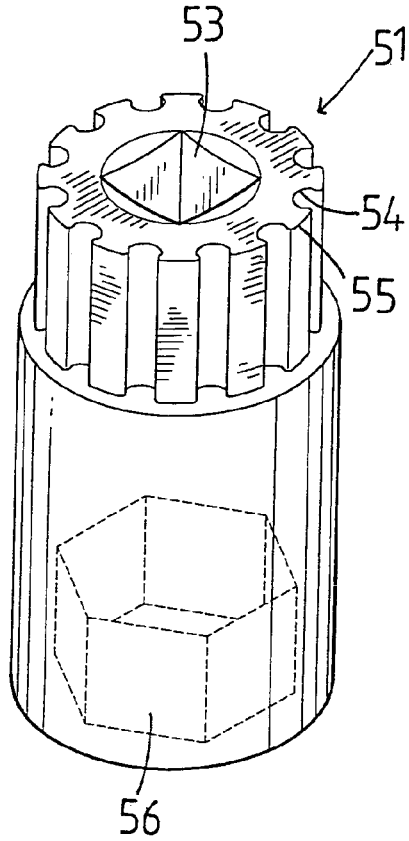
FIG. 8 shows another embodiment as a socket of the present invention.
Figure 10:
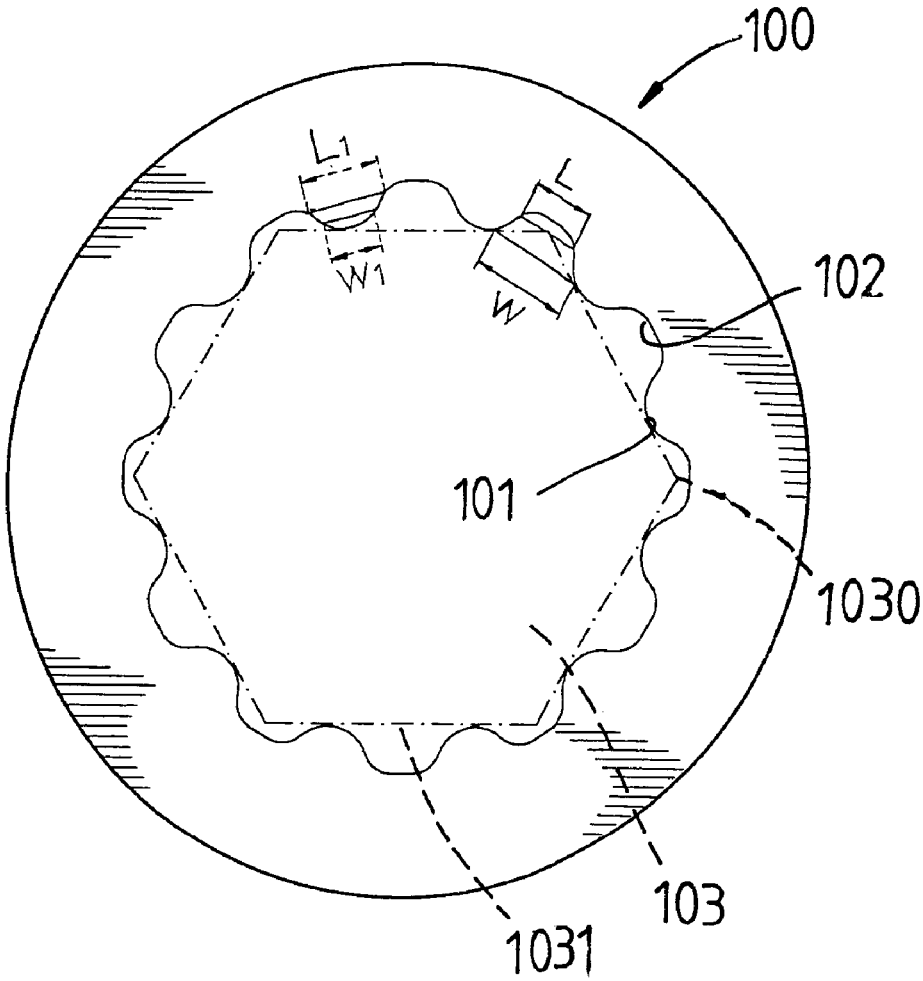
FIG. 10 PRIOR ART
FIG. 10 shows a conventional box end and a nut engaged by the conventional box end.

FIG. 8 shows that the socket in FIG. 6 can also be made to have a polygonal recess 56 defined in the first end of the tubular body 50 and the polygonal recess 56 replaces the engaging recess 52 in the first end of the tubular body 50. FIG. 9 shows that the socket in FIG. 6 can be made such that the engaging part 51 is removed and only the rectangular hole 53 is defined in the second end of the tubular body 50. Again, the width "W1" between two adjacent enlarged portions of the ridges 550 is smaller than the width "L1" of a bottom of each groove 540. The ratio of the width "W1" between two adjacent enlarged portions of the ridges 550 and the width "L1" of the bottom of the groove 540 is 1:1.2. The width "W1" between two adjacent enlarged portions is the narrowest width of each groove 540.

While we have shown and described the embodiment in accordance with the present invention, it should be clear to those skilled in the art that further embodiments may be made without departing from the scope of the present invention.

What is claimed is:

1. A polygonal member engaging device, comprising:

a box end and a handle connected to the box end, the box end having a hole defined therethrough and an engaging ring rotatably retained in the hole, the engaging ring having a plurality of ridges and grooves defined in an inner periphery of a clamping hole of the engaging ring, the ridges and the grooves being alternatively arranged from each other in the inner periphery of the clamping hole of the engaging ring, each ridge having an enlarged portion extending radially outward therefrom and a width "W1" between two adjacent enlarged portions of the ridges being smaller than a width "L1" of a bottom of each groove.

2. The device as claimed in claim 1, wherein a ratio of the width "W1" between two adjacent enlarged portions and the width "L1" of the bottom of the groove is 1:1.2.

3. The device as claimed in claim 1, wherein the width "W1" between two adjacent enlarged portions is the narrowest width of each groove.

4. A polygonal member engaging device comprising:

a tubular body and an engaging recess defined in a first end of the tubular body, an engaging part extending from a second end of the tubular body, a plurality of ridges and grooves defined in an inner periphery of the engaging recess, the ridges and the grooves being alternatively arranged from each other, each ridge having an enlarged portion extending radially outward therefrom and a width "W1" between two adjacent enlarged portions being smaller than a width "L1" of a bottom of each groove.

5. The device as claimed in claim 4, wherein a ratio of the width "W1" between two adjacent enlarged portions of the ridges and the width "L1" of the bottom of the groove is 1:1.2.

6. The device as claimed in claim 4, wherein the width "W1" between two adjacent enlarged portions is the narrowest width of each groove.

7. The device as claimed in claim 4, wherein the engaging part has a rectangular hole defined therein.

8. A polygonal member engaging device comprising:

a tubular body and an engaging recess defined in a first end of the tubular body, a rectangular hole defined in a second end of the tubular body, a plurality of ridges and grooves defined in an inner periphery of the engaging recess, the ridges and the grooves being alternatively arranged from each other, each ridge having an enlarged portion extending radially outward therefrom and a width "W1" between two adjacent enlarged portions being smaller than a width "L1" of a bottom of each groove.

9. The device as claimed in claim 8, wherein a ratio of the width "W1" between two adjacent enlarged portions of the ridges and the width "L1" of the bottom of the groove is 1:1.2.

10. The device as claimed in claim 8, wherein the width "W1" between two adjacent enlarged portions is the narrowest width of each groove.

* * * * *